US006204426B1

(12) United States Patent
Miller et al.

(10) Patent No.: US 6,204,426 B1
(45) Date of Patent: Mar. 20, 2001

(54) PROCESS FOR PRODUCING A HIGHLY PARAFFINIC DIESEL FUEL HAVING A HIGH ISO-PARAFFIN TO NORMAL PARAFFIN MOLE RATIO

(75) Inventors: Stephen J. Miller, San Francisco; Arthur John Dahlberg, Benicia; Kamala R. Krishna, Danville; Russell R. Krug, Novato, all of CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 09/474,615

(22) Filed: Dec. 29, 1999

(51) Int. Cl.[7] ..... C07C 5/22; C10G 73/44

(52) U.S. Cl. ..... 585/739; 585/740; 585/750; 585/751; 208/27; 208/950

(58) Field of Search ..... 208/27, 138, 950; 585/739, 740, 750

(56) References Cited

U.S. PATENT DOCUMENTS

| | | | | |
|---|---|---|---|---|
| 4,594,468 | | 6/1986 | Minderhoud et al. | 585/310 |
| 4,689,138 | * | 8/1987 | Miller | 208/111 |
| 5,082,989 | * | 1/1992 | Johnson | 585/748 |
| 5,135,638 | | 8/1992 | Miller | 208/27 |
| 5,498,810 | * | 3/1996 | Bogdan et al. | 585/310 |
| 5,689,031 | | 11/1997 | Berlowitz et al. | 585/734 |
| 5,866,748 | | 2/1999 | Wittenbrink et al. | 585/734 |

* cited by examiner

*Primary Examiner*—Bekir L. Yildirim
(74) *Attorney, Agent, or Firm*—Burns, Doane, Swecker & Mathis, L.L.P.

(57) ABSTRACT

A process for producing a diesel fuel having at least 70% $C_{10+}$ paraffins, wherein the iso-paraffin to normal paraffin mole ratio is 5:1 and higher. This diesel fuel is produced by from a feed containing at least 40% $C_{10+}$ normal paraffins and at least 20% $C_{26+}$ normal paraffins. It is produced by contacting that feed in an isomerization/cracking reaction zone a feed with a catalyst comprising a SAPO-11 and platinum in the presence of hydrogen (hydrogen:feed ratio of from 1,000 to 10,000 SCFB) at a temperature of from 340° C. to 420° C., a pressure of from 100 psig to 600 psig, and a liquid hourly space velocity of from 0.1 $hr^{-1}$ to 1.0 $hr^{-1}$.

22 Claims, No Drawings

PROCESS FOR PRODUCING A HIGHLY PARAFFINIC DIESEL FUEL HAVING A HIGH ISO-PARAFFIN TO NORMAL PARAFFIN MOLE RATIO

RELATED APPLICATIONS

This application is related to two other applications filed concurrently with this application. Those applications are "A Diesel Fuel Having A Very High Iso-Paraffin To Normal Paraffin Mole Ratio" (by Stephen Miller, Arthur Dahlberg, Kamala Krishna, and Russell Krug) and "A Diesel Fuel With Reduced Potential For Causing Epidermal Hyperplasia" (by Stephen Miller, Arthur Dahlberg, Kamala Krishna, Russell Krug, and Russell White).

The present invention relates to a process for producing a highly paraffinic (at least 70% $C_{10+}$ paraffins) diesel fuel having a high iso-paraffin to normal paraffin mole ratio.

BACKGROUND OF THE INVENTION

U.S. Pat. No. 4,594,468 teaches that it is desirable to have a low iso/normal ratio of paraffins in gas oils made from Fischer Tropsch catalysts. The examples show normal/iso ratios of from 2.7:1 to 7.5:1 (iso/normal ratios of from 0.13:1 to 0.37:1) in conventional processes and from 9.2 to 10.5:1 (iso/normal ratios of from 0.095:1 to 0.11:1) for examples of its invention.

U.S. Pat. No. 5,135,638 discloses isomerizing a waxy feed over a catalyst comprising a molecular sieve having generally oval 1-D pores having a minor axis between 4.2 Å and 4.8 Å and a major axis between 5.4 Å and 7.0 Å, with at least one group VIII metal. SAPO-11, SAPO-31, SAPO-41, ZSM-22, ZSM-23 and ZSM-35 are disclosed as examples of useful catalysts.

U.S. 5,689,031 teaches a clean distillate useful as a diesel fuel, produced from Fischer-Tropsch wax. The isoparaffin/normal paraffin ratio is given as being from 0.3:1 to 3.0:1, preferably from 0.7:1 to 2.0:1.

U.S. 5,866,748 teaches a solvent (not a diesel fuel) produced by hydroisomerization of a predominantly $C_8$–$C_{20}$ n-paraffinic feed. The isoparaffin/normal paraffin ratio is given as being from 0.5:1 to 9.0:1, preferably from 1:1 to 4:1.

Two papers, "Studies on Wax Isomerization for Lubes and Fuels" *Zeolites and Related Microporous Materials: State of the Art* 1994 Studies in Surface Science and Catalysis, Vol. 84, Page 2319 (1994), and "New molecular sieve process for lube dewaxing by wax isomerization" Microporous Materials 2 (1994) 439–449, disclose dewaxing by a catalytic (Pt-SAPO-11) wax isomerization process. These papers disclose isomerization selectivity for n-hexadecane of from 93% to 84% at 89% to 96% conversion, respectively, for iso/normal ratios of from 7.4:1 to 20.7:1. A third paper, "Wax Isomerization for Improved Lube Oil Quality," Proceedings, First International Conference of Refinery Processing, AlChE Natl. Mtg, New Orleans, 1998 discloses isomerization selectivity for n-$C_{24}$ lube oil of from 94% to 80% at 95% to 99.5% conversion, respectively, for iso/normal ratios of from 17.8:1 to 159:1.

SUMMARY OF THE INVENTION

The present invention provides a highly paraffinic (at least 70% $C_{10+}$ paraffins) diesel fuel having a very high iso-paraffin to normal paraffin mole ratio. The diesel fuel must have an iso-paraffin to normal paraffin mole ratio of at least 5:1, preferably at least 13:1, more preferably at least 21:1, most preferably at least about 30:1

Preferably the diesel fuel has a total paraffin content of at least 90%. The term "total paraffin content" refers to the percentage of the diesel fuel that is any type of paraffin (iso-paraffin or normal paraffin). Preferably, the diesel fuel is derived from a Fischer-Tropsch catalytic process.

The diesel fuel can be produced by contacting a highly paraffinic feed in an isomerization/cracking reaction zone with a catalyst comprising at least one Group VIII metal and a molecular sieve having generally oval 1-D pores having a minor axis between 3.9 Å and 4.8 Å and a major axis between 5.4 Å and 7.0 Å. The molecular sieve can be selected from the group consisting of SAPO-11, SAPO-31, SAPO-41, ZSM-22, ZSM-23, ZSM-35, and mixtures thereof. More preferably, it is selected from the group consisting of SAPO-11, SAPO-31, SAPO-41, and mixtures thereof. Most preferably, it is SAPO-11. Preferably, the Group VIII metal is selected from the group consisting of platinum, palladium, and mixtures thereof. More preferably, it is platinum.

At least 40% of the paraffinic feed are $C_{10+}$ normal paraffins and at least 20% of the feed are $C_{26+}$ paraffins. Preferably at least 40% of the feed are $C_{26+}$ paraffins.

Preferably, the process is carried out at a temperature of from 200° C. to 475° C., a pressure of from 15 psig to 3000 psig, and a liquid hourly space velocity of from 0.1 $hr^{-1}$ to 20 $hr^{-1}$. More preferably, it is carried out at a temperature of from 250° C. to 450° C., a pressure of from 50 to 1000 psig, and a liquid hourly space velocity of from 0.1 $hr^{-1}$ to 5 $hr^{-1}$. Most preferably, it is carried out at a temperature of from 340° C. to 420° C., a pressure of from 100 psig to 600 psig, and a liquid hourly space velocity of from 0.1 $hr^{-1}$ to 1.0 $hr^{-1}$. These process conditions are sufficient to both isomerize the $C_{10}$ to $C_{20}$ paraffins and crack the higher paraffins.

Preferably, the process is carried out in the presence of hydrogen. Preferably, the ratio of hydrogen to feed is from 500 to 30,000 standard cubic feet per barrel, more preferably from 1,000 to 10,000 standard cubic feet per barrel.

The feed has at least 40% $C_{10+}$ normal paraffins, preferably at least 50% $C_{10+}$ normal paraffins, more preferably at least 70% $C_{10+}$ normal paraffins. Preferably, the feed is derived from a Fischer-Tropsch catalytic process.

DETAILED DESCRIPTION OF THE INVENTION

In its broadest aspect, the present invention involves a highly paraffinic (at least 70% $C_{10+}$ paraffins) diesel fuel having a very high iso-paraffin to normal paraffin mole ratio (at least 5:1). In one embodiment, the diesel fuel has an iso-paraffin to normal paraffin mole ratio of at least 21:1, preferably at least about 30:1.

One possible benefit of such a diesel fuel is reduced toxicity. Other benefits of such a diesel fuel could include improved cold filter plugging performance, when distillation end point is kept the same. The necessity to meet cold filter plugging specification limits distillation end point and, therefore limits yield, which in turn limits project economics. Where distillation end point is increased (such as to the cold filter plugging limit) other possible improvements include cetane number, lubricity, and energy density.

DEFINITIONS

As used herein the following terms have the following meanings unless expressly stated to the contrary:

The term "total paraffin content" refers to the percentage of the diesel fuel that is either iso-paraffin or normal paraffin.

The term "diesel fuel" refers to hydrocarbons having boiling points in the range of from 350° to 700° F. (177° to 371° C.).

The term "$C_{10+}$ paraffins" refers to paraffins having at least ten carbon atoms per molecule, as determined by having a boiling point of at least 350° F. (177° C.).

The term "$C_{26+}$ paraffins" refers to paraffins having at least twenty six carbon atoms per molecule, as determined by having a boiling point of at least 775° F. (413° C.).

Unless otherwise specified, all percentages are in weight percent.

THE HIGHLY PARAFFINIC FEED

The feed is highly paraffinic, having at least 40% $C_{10+}$ normal paraffins and at least 20% $C_{26+}$ paraffins. Preferably, the feed has at least 40% $C_{26+}$ paraffins. Preferably, the feed has at least 50% $C_{10+}$ normal paraffins, more preferably at least 70% $C_{10+}$ normal paraffins.

Preferably, the feed is derived from a Fischer-Tropsch catalytic process. Fischer-Tropsch conditions are well known to those skilled in the art. Preferably, the temperature is in the range of from 150° C. to 350° C., especially 180° C. to 240° C., and the pressure is in the range of from 100 to 10,000 kPa, especially 1000 to 5000 kPa. Any suitable Fischer-Tropsch catalyst maybe used, for example one based on cobalt or iron, and, if the catalyst comprises cobalt or iron on a support, very many different supports may be used, for example silica, alumina, titania, ceria, zirconia or zinc oxide. The support may itself have some catalytic activity. Preferably the catalyst contains from 2 to 25%, especially from 5 to 15% cobalt or iron. Alternatively, the catalyst may be used without a support. In this case, the catalyst is often prepared in the form of an oxide. Active metal catalytic components or promoters may be present as well as cobalt or iron if desired.

Other suitable feeds include foots oils, synthetic waxes, slack waxes, and deoiled waxes. Foots oil is prepared by separating oil from the wax. The isolated oil is referred to as foots oil

THE ISOMERIZATION/CRACKING PROCESS

This diesel fuel can be produced by contacting a highly paraffinic feed in an isomerization/cracking reaction zone with an isomerization catalyst comprising at least one Group VIII metal and a catalytic support to produce a diminished level of $C_{30+}$ paraffins.

The process of the invention may be conducted by contacting the feed with a fixed stationary bed of catalyst, with a fixed fluidized bed, or with a transport bed. A simple and therefore preferred configuration is a trickle-bed operation in which the feed is allowed to trickle through a stationary fixed bed, preferably in the presence of hydrogen.

Generally, the temperature is from 200° C. to 475° C., preferably from 250° C. to 450° C., more preferably from 340° C. to 420° C. The pressure is typically from 15 psig to 3000 psig, preferably from 50 to 1000 psig, more preferably from 100 psig to 600 psig. The liquid hourly space velocity (LHSV) is preferably from 0.1 $hr^{-1}$ to 20 $hr^{-1}$, more preferably from 0.1 $hr^{-1}$ to 5 $hr^{-1}$, and most preferably from 0.1 $hr^{-1}$ to 1.0 $hr^{-1}$.

Hydrogen is preferably present in the reaction zone during the catalytic isomerization process. The hydrogen to feed ratio is typically from 500 to 30,000 SCF/bbl (standard cubic feet per barrel), preferably from 1,000 to 10,000 SCF/bbl. Generally, hydrogen will be separated from the product and recycled to the reaction zone.

The process produces a diesel fuel having an iso-paraffin to normal paraffin mole ratio of at least 5:1, preferably at least 13:1, more preferably at least 21:1, most preferably at least 30:1. Like the feed to the isomerization/cracking process, the resulting product is highly paraffinic, having at least 70% $C_{10+}$ paraffins, preferably at least 80% $C_{10+}$ paraffins, more preferably at least 90% $C_{10+}$ paraffins.

The isomerization/cracking process can be used in conjunction with a hydrocracking process. The process of this invention can be carried out by combining the silicoaluminophosphate molecular sieve with the hydrocracking catalyst in a layered bed or a mixed bed. Alternatively, the intermediate pore size silicoaluminophoaphate molecular sieve can be included in the hydrocracking catalyst particles, or a catalyst containing both the silicoaluminophosphate molecular sieve and the hydroprocessing catalyst can be employed. When the hydrocracking catalyst particles contain the silicoaluminophosphate molecular sieve, and the latter contains a noble metal, then preferably the hydrogenation component of the hydrocracking catalyst is also a noble, rather than base, metal. Further, the silicoaluminophosphate molecular sieve and the hydrocracking catalyst can be run in separate reactors. Preferably, the catalysts are employed in discreet layers with the hydrocracking catalyst placed on top (i.e., nearer the feed end of the process) of the silicoaluminophosphate catalyst. The amount of each catalyst employed depends upon the amount of pour point reduction desired in the final product. In general, the weight ratio of the hydrocracking catalyst to the silicoaluminophosphate molecular sieve containing catalyst is from about 1:5 to about 20: 1. When a layered bed system is employed, the catalysts can be run at separate temperatures, which can effect the degree of dewaxing. When separate reactors or separate beds are employed to carry out the process of the invention, the ratio of the catalysts and the temperature at which the process is carried out can be selected to achieve desired pour points.

Isoparaffin to normal paraffin ratio can be adjusted by adjusting conversion of the normal paraffins over the isomerization catalyst. This conversion can be increased by increasing catalyst temperature or by decreasing the liquid hourly space velocity until the target is reached, typically as determined by gas chromatography.

In the above embodiments, product diesel can be recovered by distillation, such as after the isomerization/cracking step, with the unconverted heavy fraction returned to the isomerization/cracking step (or a previous hydrocracking step) for further conversion. Alternatively, some of the unconverted heavy fraction from the isomerization/cracking step may be recovered as a low pour lube oil.

DETERMINATIONS OF ISOPARAFFIN TO NORMAL PARAFFIN RATIO

The normal paraffin analysis of a naphthenic wax is determined using the following gas chromatographic (GC) technique. A baseline test is made to determine the retention times of a known mixture of $C_{20}$ to $C_{40}$ normal paraffins. To make the determination, approximately 5 ml of carbon disulfide is added to a weighed amount of the known mixture in a 2-dram vial. Two microliters of the $CS_2$/known sample are injected into a HP-5711 gas chromatograph, which is operated using the following parameters:

Carrier gas—helium

Splitter flow—50 ml/min

Inlet pressure—30 psig

Make-up gas—nitrogen

Make-up flow—25 ml/min (@ 8 psig)

FID hydrogen—20 ml/min (@ 16 psig)

FID air—300 ml/min(40 psig)

Injector Temperature—350° C.

Detector Temperature—300° C.

Column—15 m×0.32 mm ID fused silica capillary coated with DB-1. Available from J&W Scientific.

Oven Temperature Program—(150° C. initial, 4 min. delay, 4° C./min rate, 270° C. final temp, 26-min final temp hold.

The peaks in the resulting GC trace are correlated with the identity of each of the normal paraffins in the known mixture.

The gas chromatographic analysis is then repeated on a sample of the unknown wax. A weighted amount of the unknown wax is dissolved in 5 ml of $CS_2$ and the solution injected into the gas chromatograph, which is operated using the parameters listed above. The resulting GC trace is analyzed as follows:

(a) Each peak attributable to each normal paraffin $C_x$ present in the wax is identified.

(b) The relative area of each normal paraffin peak is determined by standard integration methods. Note that only the portion of the peak directly attributable to the normal paraffin, and excluding the envelope at the base of the peak attributable to other hydrocarbons, is included in this integration.

(c) The relative area representing the total amount of each hydrocarbon $C_n$ (both normal and non normal) in the wax sample is determined from a peak integration from the end of the $C_{n-1}$ normal paraffin peak to the end of the $C_n$ peak. The weight percentage of each normal paraffin in the wax is determined by relating the area of the normal paraffin peak to the total area attributable to each carbon number component in the wax.

The normal paraffin content of waxes boiling at temperatures beyond the range of the gas chromatograph are estimated from literature references to waxes having similar physical properties.

HYDROCRACKING CATALYSTS

In one embodiment, the catalyst is used with a hydrocracking catalyst comprising at least one Group VIII metal, preferably also comprising at least one Group VI metal.

Hydrocracking catalysts include those having hydrogenation-dehydrogenation activity, and active cracking supports. The support is often a refractory inorganic oxide such as silica-alumina, silica-alumina-zirconia, silica-alumina-phosphate, and silica-alumina-titania composites, acid treated clays, crystalline aluminosilicate zeolitic molecular sieves such as faujasite, zeolite X, zeolite Y, and the like, as well as combinations of the above. Preferably, the large-pore hydrocracking catalysts have pore sizes of about 10 Å or more and more preferably of about 30 Å or more.

Hydrogenation-dehydrogenation components of the hydrocracking catalyst usually comprise metals selected from Group VIII and Group VI-B of the Periodic Table, and compounds including them. Preferred Group VIII components include cobalt, nickel, platinum and palladium, particularly the oxides and sulfides of cobalt and nicket. Preferred Group VI-B components are the oxides and sulfides of molybdenum and tungsten.

Thus, examples of hydrocracking catalysts are nickel-tungsten-silica-alumina and nickel-molybdenum-silica-tungsten. Preferably, it is nickel-tungsten-silica-alumina or nickel-tungsten-silica-alumina-phosphate.

ISOMERIZATION CATALYSTS

The term "intermediate pore size" refers to an effective pore aperture in the range of from 5.3 Å to 6.5 Å when the porous inorganic oxide is in the calcined form. Molecular sieves having pore apertures in this range tend to have unique molecular sieving characteristics. Unlike small pore zeolites such as erionite and chabazite, they will allow hydrocarbons having some branching into the molecular sieve void spaces. Unlike larger pore zeolites, such as the faujasites and mordenites, they can differentiate between n-alkanes and slightly branched alkanes, and larger branched alkanes having, for example, quaternary carbon atoms.

The effective pore size of the molecular sieves can be measured using standard adsorption techniques and hydrocarbonaceous compounds of known minimum kinetic diameters. See Breck, *Zeolite Molecular Sieves*. 1974 (especially Chapter 8); Anderson, et al., J. Catalysis 58,114 (1979); and U.S. Pat. No. 4,440,871, the pertinent portions of which are incorporated herein by reference.

In performing adsorption measurements to determine pore size, standard techniques are used. It is convenient to consider a particular molecule as excluded if it does not reach at least 95% of its equilibrium adsorption value on the molecular sieve in less than about 10 minutes (p/po=0.5; 25° C.).

Intermediate pore size molecular sieves will typically admit molecules having kinetic diameters of 5.3 to 6.5 Å with little hindrance. Examples of such compounds (and their kinetic diameters in Å) are: n-hexane (4.3), 3-methylpentane (5.5), benzene (5.85), and toluene (5.8). Compounds having kinetic diameters of about 6 to 6.5 Å can be admitted into the pores, depending on the particular sieve, but do not penetrate as quickly and in some cases are effectively excluded. Compounds having kinetic diameters in the range of 6 to 6.5 Å include: cyclohexane (6.0), 2,3-dimethylbutane (6.1), and m-xylene (6.1). Generally, compounds having kinetic diameters of greater than about 6.5 Å do not penetrate the pore apertures and thus are not absorbed into the interior of the molecular sieve lattice. Examples of such larger compounds include: o-xylene (6.8), 1,3,5-trimethylbenzene (7.5), and tributylamine (8.1).

The preferred effective pore size range is from about 5.5 to about 6.2 Å.

It is essential that the intermediate pore size molecular sieve catalysts used in the practice of the present invention have a very specific pore shape and size as measured by X-ray crystallography. First, the intracrystalline channels must be parallel and must not be interconnected. Such channels are conventionally referred to as 1-D diffusion types or more shortly as 1-D pores. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75). Known 1-D zeolites include cancrinite hydrate, laumontite, mazzite; mordenite and zeolite L.

None of the above listed 1 -D pore zeolites, however, satisfies the second essential criterion for catalysts useful in the practice of the present invention. This second essential criterion is that the pores must be generally oval in shape, by which is meant the pores must exhibit two unequal axes referred to herein as a minor axis and a major axis. The term oval as used herein is not meant to require a specific oval or elliptical shape but rather to refer to the pores exhibiting two unequal axes. In particular, the 1-D pores of the catalysts useful in the practice of the present invention must have a minor axis between about 3.9 Å and about 4.8 Å and a major axis between about 5.4 Å and about 7.0 Å as determined by conventional X-ray crystallography measurements.

The most preferred intermediate pore size silicoaluminophosphate molecular sieve for use in the process of the invention is SAPO-11. SAPO-11 comprises a molecular framework of corner-sharing [$SiO_2$] tetrahedra, [$AlO_2$] tetrahedra and [$PO_2$] tetrahedra, [i.e., $(S_xAl_yP_z)O_2$ tetrahedral units]. When combined with a Group VIII metal hydrogenation component, the SAPO-11 converts the waxy components to produce a lubricating oil having excellent yield, very low pour point, low viscosity and high viscosity index. SAPO-11 is disclosed in detail in U.S. Pat. No. 5,135,638, which is hereby incorporated by reference for all purposes.

Other intermediate pore size silicoaluminophosphate molecular sieves useful in the process of the invention are SAPO-31 and SAPO-41, which are also disclosed in detail in U.S. Pat. No. 5,135,638.

Also useful are catalysts comprising an intermediate pore size nonzeolitic molecular sieves, such as ZSM-22, ZSM-23 and ZSM-35, and at least one Group VIII metal. X-ray crystallography of SAPO-11, SAPO-31, SAPO-41, ZSM-22, ZSM-23 and ZSM-35 shows these molecular sieves to have the following major and minor axes: SAPO-11, major 6.3 Å, minor 3.9 Å; (Meier, W. H., Olson, D. H., and Baerlocher, C., Atlas of Zeolite Structure Types, Elsevier, 1996), SAPO-31 and SAPO-41, believed to be slightly larger than SAPO-11, ZSM-22, major 5.5 Å, minor 4.5 Å (Kokotailo, G. T., et al, Zeolites, 5, 349(85)); ZSM-23, major 5.6 Å, minor 4.5 Å; ZSM-35, major 5.4 Å, minor 4.2 Å (Meier, W. M. and Olsen, D. H., Atlas of Zeolite Structure Types, Butterworths, 1987).

The intermediate pore size molecular sieve is used in admixture with at least one Group VIII metal. Preferably the Group VIII metal is selected from the group consisting of at least one of platinum and palladium and optionally, other catalytically active metals such as molybdenum, nickel, vanadium, cobalt, tungsten, zinc and mixtures thereof. More preferably, the Group VIII metal is selected from the group consisting of at least one of platinum and palladium. The amount of metal ranges from about 0.01% to about 10% by weight of the molecular sieve, preferably from about 0.2% to about 5% by weight of the molecular sieve. The techniques of introducing catalytically active metals into a molecular sieve are disclosed in the literature, and preexisting metal incorporation techniques and treatment of the molecular sieve to form an active catalyst such as ion exchange, impregnation or occlusion during sieve preparation are suitable for use in the present process. Such techniques are disclosed in U.S. Pat. Nos. 3,236,761; 3,226,339; 3,236,762; 3,620,960; 3,373,109; 4,202,996; 4,440,781 and 4,710,485 which are incorporated herein by reference.

The term "metal" or "active metal" as used herein means one or more metals in the elemental state or in some form such as sulfide, oxide and mixtures thereof. Regardless of the state in which the metallic component actually exists, the concentrations are computed as if they existed in the elemental state.

The catalyst may also contain metals, which reduce the number of strong acid sites on the catalyst and thereby lower the selectivity for cracking versus isomerization. Especially preferred are the Group IIA metals such as magnesium and calcium.

It is preferred that relatively small crystal size catalyst be utilized in practicing the invention. Suitably, the average crystal size is no greater than about 10.mu., preferably no more than about 5.mu., more preferably no more than about 1.mu. and still more preferably no more than about 0.5.mu.

Strong acidity may also be reduced by introducing nitrogen compounds, e.g., $NH_3$ or organic nitrogen compounds, into the feed; however, the total nitrogen content should be less than 50 ppm, preferably less than 10 ppm. The physical form of the catalyst depends on the type of catalytic reactor being employed and may be in the form of a granule or powder, and is desirably compacted into a more readily usable form (e.g., larger agglomerates), usually with a silica or alumina binder for fluidized bed reaction, or pills, prills, spheres, extrudates, or other shapes of controlled size to accord adequate catalyst-reactant contact. The catalyst may be employed either as a fluidized catalyst, or in a fixed or moving bed, and in one or more reaction stages.

The intermediate pore size molecular sieve catalyst can be manufactured into a wide variety of physical forms. The molecular sieves can be in the form of a powder, a granule, or a molded product, such as an extrudate having a particle size sufficient to pass through a 2-mesh (Tyler) screen and be retained on a 40-mesh (Tyler) screen. In cases wherein the catalyst is molded, such as by extrusion with a binder, the silicoaluminophosphate can be extruded before drying, or, dried or partially dried and then extruded.

The molecular sieve can be composited with other materials resistant to temperatures and other conditions employed in the isomerization process. Such matrix materials include active and inactive materials and synthetic or naturally occurring zeolites as well as inorganic materials such as clays, silica and metal oxides. The latter may be either naturally occurring or in the form of gelatinous precipitates, sols or gels including mixtures of silica and metal oxides. Inactive materials suitably serve as diluents to control the amount of conversion in the isomerization process so that products can be obtained economically without employing other means for controlling the rate of reaction. The molecular sieve may be incorporated into naturally occurring clays, e.g., bentonite and kaolin. These materials, i.e., clays, oxides, etc., function, in part, as binders for the catalyst. It is desirable to provide a catalyst having good crush strength because in petroleum refining, the catalyst is often subjected to rough handling. This tends to break the catalyst down into powder-like materials which cause problems in processing.

Naturally occurring clays which can be composited with the molecular sieve include the montmorillonite and kaolin families, which families include the sub-bentonites, and the kaolins commonly known as Dixie, McNamee, Georgia and Florida clays or others in which the main mineral constituent is halloysite, kaolinite, diokite, nacrite or anauxite. Fibrous clays such as halloysite, sepiolite and attapulgite can also be use as supports. Such clays can be used in the raw state as originally mined or initially subjected to calcination, acid treatment or chemical modification.

In addition to the foregoing materials, the molecular sieve can be composited with porous matrix materials and mixtures of matrix materials such as silica, alumina, titania, magnesia, silica-alumina, silica-magnesia, silica-zirconia, silica-thoria, silica-beryllia, silica-titania, titania-zirconia as well as ternary compositions such as silica-alumina-thoria, silica-alumina-titania, silica-alumina-magnesia and silica-magnesia-zirconia. The matrix can be in the form of a cogel.

The catalyst used in the process of this invention can also be composited with other zeolites such as synthetic and natural faujasites, (e.g., X and Y) erionites, and mordenites. It can also be composited with purely synthetic zeolites such as those of the ZSM series. The combination of zeolites can also be composited in a porous inorganic matrix.

EXAMPLES

The invention will be further illustrated by following examples, which set forth particularly advantageous method embodiments. While the Examples are provided to illustrate the present invention, they are not intended to limit it.

Example 1

A commercial Fischer-Tropsch wax was purchased from Moore and Munger. Inspections of the wax are shown in Table I.

TABLE I

| Inspections of Fischer-Tropsch Wax | |
|---|---|
| Gravity, API | 35.8 |
| Carbon, % | 85.0 |
| Hydrogen, % | 14.6 |
| Oxygen, % | 0.19 |
| Nitrogen, % | <1.0 |
| Viscosity, 150° C., cSt | 7.757 |
| Cloud Point, ° C. | +119 |
| Sim. Dist., ° F., LV % | |
| ST/5 | 827/878 |
| 10/30 | 905/990 |
| 50 | 1070 |
| 70/90 | 1160/1276 |
| 95/EP | 1315/1357 |

This wax was hydrocracked over a Pt/SAPO-11 catalyst at 695° F. (368° C.), 0.5 LHSV, 1000 psig total pressure, and 6000 SCF/bbl $H_2$. This produced a 350–650° F. diesel, with a yield of about 20% based on feed. Inspections of this diesel are given in Table II. These show the diesel to have a very high iso/normal paraffin ratio, coupled with very low pour and cloud points.

TABLE II

| Inspections of Diesel Cut from Hydrocracking F-T Wax of Table I | |
|---|---|
| Gravity, API | 51.2 |
| Pour Point, ° C. | <−55 |
| Cloud Point, ° C. | <−60 |
| Viscosity, 40° C., cSt | 1.983 |
| Iso/Normal Paraffin Ratio | 34.5 |
| Sim. Dist., ° F., LV % | |
| ST/5 | 321/352 |
| 10/30 | 364/405 |
| 50 | 459 |
| 70/90 | 523/594 |
| 95/EP | 615/636 |

Example 2

The run described in Example 1 was continued, but at a catalyst temperature of 675° F. (357° C.), a LHSV of 1.0, 1000 psig total pressure, and 6500 SCF/bbl $H_2$. This produced a 350–650° F. diesel, with a yield of about 20% based on feed. Inspections of this diesel are given in Table III.

TABLE III

| Inspections of Diesel Cut from Hydrocracking F-T Wax of Table I | |
|---|---|
| Gravity, API | 50.8 |
| Pour Point, ° C. | <−53 |
| Cloud Point, ° C. | −48 |
| Viscosity, 40° C., cSt | 2.305 |
| Iso/Normal Paraffin Ratio | 22.1 |
| Sim. Dist., ° F., LV % | |
| ST/5 | 318/353 |
| 10/30 | 368/435 |
| 50 | 498 |
| 70/90 | 559/620 |
| 95/EP | 635/649 |

Example 3

The run described in Example 1 was continued, but at a catalyst temperature of 660° F. (349° C.), a LHSV of 1.0, 1000 psig total pressure, and 6000 SCF/bbl $H_2$. This produced a 350–650° F. diesel, with a yield of about 13% based on feed. Inspections of this diesel are given in Table IV.

TABLE IV

| Inspections of Diesel Cut from Hydrocracking F-T Wax of Table I | |
|---|---|
| Gravity, API | 51.2 |
| Pour Point, ° C. | <−51 |
| Cloud Point, ° C. | −41 |
| Viscosity, 40° C., cSt | 2.259 |
| Iso/Normal Paraffin Ratio | 13.4 |
| Sim. Dist., ° F., LV % | |
| ST/5 | 304/350 |
| 10/30 | 368/437 |
| 50 | 500 |
| 70/90 | 556/611 |
| 95/EP | 624/637 |

Comparative Example

A Fischer-Tropsch wax feed similar to the one used in Example 1 was hydrocracked over an amorphous Ni—W—$SiO_2$—$Al_2O_3$ hydrocracking catalyst at 680° F., 1 LHSV, 1000 psig total pressure, and 9000 SCF/bbl $H_2$. Feed inspections are given in Table V. Unconverted 650° F.+ material was recycled back to the reactor. This produced a 350–650° F. diesel, with a yield of about 90% based on feed. Inspections of this diesel are given in Table VI, showing a low iso/normal paraffin ratio and much higher cloud point than in the diesel produced with this invention.

TABLE V

| Inspections of Fischer-Tropsch Wax | |
|---|---|
| Gravity, API | 40.2 |
| Sim. Dist., ° F., LV % | |
| ST/5 | 120/518 |
| 10/30 | 562/685 |
| 50 | 792 |
| 70/90 | 914/1038 |
| 95/EP | 1080/1148 |

TABLE VI

| Inspections of Diesel Cut from Hydrocracking F-T Wax of Table V | |
|---|---|
| Gravity, API | 49.4 |
| Pour Point, ° C. | −16 |
| Cloud Point, ° C. | −13 |
| Viscosity, 40° C., cSt | 2.908 |
| Iso/Normal Paraffin Ratio | 4.58 |
| Sim. Dist., ° F., LV % | |
| ST/5 | 321/369 |
| 10/30 | 402/495 |
| 50 | 550 |
| 70/90 | 602/648 |
| 95/EP | 658/669 |

While the present invention has been described with reference to specific embodiments, this application is intended to cover those various changes and substitutions that may be made by those skilled in the art without departing from the spirit and scope of the appended claims.

What is claimed is:

1. A process for producing a diesel fuel comprising contacting in an isomerization/cracking reaction zone a feed having at least 40% $C_{10+}$ normal paraffins and at least 20% $C_{26+}$ paraffins with a catalyst comprising at least one Group VIII metal on a catalytic support to produce a product having an iso-paraffin to normal paraffin mole ratio of at least 5:1 and having a diminished level of $C_{26+}$ paraffins.

2. A process according to claim 2 wherein said feed has at least 40% $C_{26+}$ paraffins.

3. A process according to claim 1 wherein said process is carried out at a temperature of from 200° C. to 475° C., a pressure of from 15 psig to 3000 psig, and a liquid hourly space velocity of from 0.1 $hr^{-1}$ to 20 $hr^{-1}$.

4. A process according to claim 3 wherein said process is carried out at a temperature of from 250° C. to 450° C., a pressure of from 50 to 1000 psig, and a liquid hourly space velocity of from 0.1 $hr^{-1}$ to 5 $hr^{-1}$.

5. A process according to claim 4 wherein said process is carried out at a temperature of from 340° C. to 420° C., a pressure of from 100 psig to 600 psig, and a liquid hourly space velocity of from 0.1 $hr^{-1}$ to 1.0 $hr^{-1}$.

6. A process according to claim 1 wherein said process is carried out in the presence of hydrogen.

7. A process according to claim 6 wherein the ratio of hydrogen to feed is from 500 to 30,000 standard cubic feet per barrel.

8. A process according to claim 7 wherein the ratio of hydrogen to feed is from 1,000 to 10,000 standard cubic feet per barrel.

9. A process according to claim 1 wherein said feed has at least 50% $C_{10+}$ normal paraffins.

10. A process according to claim 9 wherein said feed has at least 70% $C_{10+}$ normal paraffins.

11. A process according to claim 10 wherein said feed is derived from a Fischer-Tropsch catalytic process.

12. A process according to claim 1 wherein said diesel fuel has an iso-paraffin to normal paraffin mole ratio of at least 13:1.

13. A process according to claim 12 wherein said diesel fuel has an iso-paraffin to normal paraffin mole ratio of at least 21:1.

14. A process according to claim 13 wherein said diesel fuel has an iso-paraffin to normal paraffin mole ratio of at least 30:1.

15. A process according to claim 13 wherein said molecular sieve has generally oval 1-D pores having a minor axis between 3.9 Å and 4.8 Å and a major axis between 5.4 Å and 7.0 Å.

16. A process according to claim 15 wherein said molecular sieve is selected from the group consisting of SAPO-11, SAPO-31, SAPO-41, ZSM-22, ZSM-23, ZSM-35 and mixtures thereof.

17. A process according to claim 16 wherein said molecular sieve is selected from the group consisting of SAPO-11, SAPO-31, SAPO-41, and mixtures thereof.

18. A process according to claim 17 wherein said molecular sieve is SAPO-11.

19. A process according to claim 1 wherein said Group VIII metal is selected from the group consisting of platinum, palladium, and mixtures thereof.

20. A process according to claim 19 wherein said Group VIII metal is platinum.

21. A diesel fuel produced by the process according to claim 1.

22. A process for producing a diesel fuel comprising contacting in an isomerization reaction zone a feed with a catalyst comprising a SAPO-11 and platinum in the presence of hydrogen at a temperature of from 340° C. to 420° C., a pressure of from 100 psig to 600 psig, and a liquid hourly space velocity of from 0.1 $hr^{-1}$ to 1.0 $hr^{-1}$ to produce a product having an iso-paraffin to normal paraffin mole ratio of at least 30:1 and having a diminished level of $C_{26+}$ paraffins, wherein the ratio of hydrogen to feed is from 1,000 to 10,000 standard cubic feet per barrel, and wherein said feed derived from a Fischer-Tropsch catalytic process and contains at least 70% $C_{10+}$ normal paraffins and at least 40% $C_{26+}$ paraffins.

* * * * *